US005172821A

United States Patent [19]

Knopf

[11] Patent Number: 5,172,821

[45] Date of Patent: Dec. 22, 1992

[54] CLOSURE FOR KEEPING OPENED BOTTLES OF SPARKLING WINE FRESH

[76] Inventor: Eugenie Knopf, Schwetzinger Str. 4, 5000 Cologne 91, Fed. Rep. of Germany

[21] Appl. No.: 620,634

[22] Filed: Dec. 3, 1990

[30] Foreign Application Priority Data

Jan. 22, 1990 [DE] Fed. Rep. of Germany ..... 4001663
May 23, 1990 [DE] Fed. Rep. of Germany ..... 4016592

[51] Int. Cl.[5] ..... B65D 45/04

[52] U.S. Cl. ..... 215/286; 215/213; 215/273; 215/280; 215/311; 215/364

[58] Field of Search ..... 215/364, 355, 204, 248, 215/260, 280, 286, 294, 296, 273, 287, 290, 213

[56] References Cited

U.S. PATENT DOCUMENTS

| | | | |
|---|---|---|---|
| 38,288 | 4/1863 | Cowles | 215/287 |
| 205,011 | 6/1878 | Templeton | 215/287 |
| 337,202 | 3/1886 | Seymour | 215/287 |
| 363,870 | 5/1887 | Wetzel | 215/287 |
| 381,136 | 4/1888 | Hirsch | 215/290 |
| 421,226 | 2/1890 | Baldwin | 215/273 |
| 438,711 | 10/1890 | Painter | 215/290 |
| 656,698 | 8/1900 | Marchand | 215/260 |
| 686,315 | 11/1901 | Marchand | 215/260 |
| 798,775 | 9/1905 | Forsyth | 215/287 |
| 816,244 | 3/1906 | McGarry | 215/287 |
| 1,176,351 | 3/1916 | Denny | 215/213 |
| 1,292,919 | 1/1919 | Thatcher | 215/287 |
| 2,669,370 | 2/1954 | Royall, Jr. | 215/355 |
| 2,746,632 | 5/1956 | Bramming | 215/296 X |
| 2,921,708 | 1/1960 | Marcel | 215/364 X |
| 3,128,896 | 4/1964 | Schnier | 215/364 |
| 3,842,790 | 10/1974 | Clark | 215/228 |
| 4,502,604 | 3/1985 | Martus | 215/206 |
| 4,687,115 | 8/1987 | Bongiovanni | 215/355 |
| 4,932,543 | 6/1990 | Martus | 215/6 |
| 4,998,633 | 3/1991 | Schneider | 215/311 |

FOREIGN PATENT DOCUMENTS

| | | | |
|---|---|---|---|
| 2211152 | 9/1973 | Fed. Rep. of Germany . | |
| 3901711 | 8/1989 | Fed. Rep. of Germany . | |
| 1098086 | 7/1955 | France . | |
| 116904 | 9/1919 | United Kingdom | 215/290 |

*Primary Examiner*—Allan N. Shoap
*Assistant Examiner*—Vanessa Caretto
*Attorney, Agent, or Firm*—Foley & Lardner

[57] ABSTRACT

In order to keep opened bottles of sparkling wine fresh, a bottle closure device has been created which consists of a stopper which can be easily inserted and which sits without further manipulation in the bottle neck in a sealing manner so as to be axially displaceable. The device is also provided with a bracket retaining device which has upper and lower retaining fingers for holding the stopper and simultaneously engaging underneath the rim of the bottle neck. The stopper also has a gas injection bore with a non-return valve in order to inject freshness-retaining gas pressure.

7 Claims, 1 Drawing Sheet

CLOSURE FOR KEEPING OPENED BOTTLES OF SPARKLING WINE FRESH

BACKGROUND OF THE INVENTION

The present invention relates to a bottle closure device for keeping opened bottles of sparkling wine fresh and providing for the introduction of carbon dioxide.

Many consumers store opened bottles of sparkling wine in order to serve them again within the following days. In many cases these bottles are fitted with a closure which has the sole purpose of closing the bottle of sparkling wine in a sealing manner.

While being stored, the carbon dioxide retained in the sparkling wine often escapes and rises up into the space which has become free in the bottle. The carbon dioxide builds up a cushion of pressure in the free space. This pressure build-up often causes a "pop" to be heard when the bottle is opened.

In order to prevent the escape of carbon dioxide and keep the sparkling wine sparklingly fresh, closures are already known in the prior art which seal the bottle and retain the carbon dioxide.

For example, according to German Offenlegungsschrift 2,211,152, a closure is known in which a stopper part can be inserted into the bottle neck and secured. A gas lead-in bore and a nonreturn valve are situated axially and centrically in the stopper part, through which the air or $CO_2$ pressure can be blown into the volume of the bottle which has become free. This counter-pressure prevents the carbon dioxide retained in the sparkling wine from escaping and rising up into the free space.

The closure stoppers of such devices are, however, constructed in a very elaborate and complicated manner which means that they are expensive and, furthermore, awkward to use.

French Patent No. 1,098,086 discloses a retaining device for stoppers in bottles of sparkling wine, wherein the device engages underneath the rim of the bottle in the closed position and also rests on the stopper at the top.

German Offenlegungsschrift 3,901,711 discloses a closure stopper for bottles of sparkling wine, on the stopper shaft of which are arranged radially projecting sealing ribs which extend in the circumferential direction.

SUMMARY OF THE INVENTION

The object of the invention is to provide an improved bottle closure device which retains the freshness of sparkling wine but is extremely economical and simple and quick to use.

In order to achieve this object, a bottle closure device has been provided which comprises a stopper having a head portion with an elongated shaft extending downwardly from the head portion, and is insertable into the neck of the bottle. The stopper also has a gas passage bore disposed along a vertical axis therein and a nonreturn valve centrically disposed therein for feeding carbon dioxide into the bottle.

The novel closure device also includes a retaining device for retaining the stopper within the bottle neck, the retaining device comprising a generally U-shaped bracket having first and second angled walls; at least two fork shaped lower fingers extending from the first angled walls defining a recess therein; and at least two fork shaped upper fingers extending from the second angled walls and defining a second recess therein. Thus, when the bracket is placed around the stopper to close the bottle, the lower fingers engage the rim of the bottle and the upper fingers engage the head portion of the stopper. The second recess also forms a thumb pressure opening which enables the stopper to be pushed into the bottle by placing a thumb at the thumb pressure-opening, thereby allowing for easier insertion of the stopper into the bottle neck and providing for a controlled reopening of the bottle. Radially projecting ribs are also formed on the stopper shaft and extend in a circumferential direction to form sealing elements for sealing the stopper within the bottle.

According to one aspect of the invention, the stopper is produced in at least two parts, with the head portion and the core of the stopper being formed with a harder core material, and a rubber sleeve forming the exterior of the shaft and the radially projecting circumferential ribs.

Further objects, features and advantages of the present invention will become apparent from the detailed description of preferred embodiments which follows, when considered together with the attached figures of drawing.

BRIEF DESCRIPTION OF THE DRAWINGS

FIG. 4 also reveals, in cross-section, the spherical upper side 16 of the stopper head.

DETAILED DESCRIPTION OF THE PREFERRED EMBODIMENTS

A closure has been created in which the stopper 1 sits in the bottle neck so that it can be easily inserted by hand and also easily removed. The stopper is inserted in a sealing manner so as to be axially displaceable and absolutely airtight without additional pressure in its sealing seat, for example by extending or spreading its outer diameter with additional aids from outside. The closure device also includes a retaining device for clamping the stopper to the bottle, by engaging itself underneath the rim of the bottle and fixing the stopper in the bottle.

Figure 1:
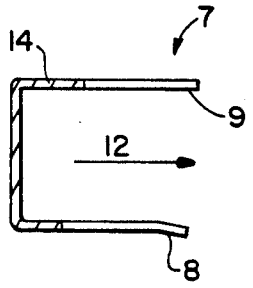
FIG. 1 shows a side view in cross-section of the retaining device, which is constructed as a metal bracket bent in a U-shape.
Figure 2:
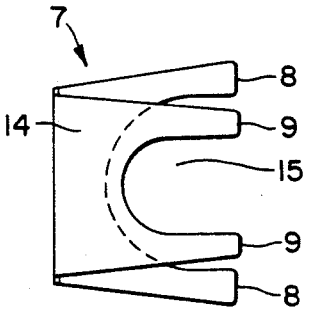
FIG. 2 shows the plan view of the same bracket. In this, the pairs of retaining fingers 8/8 and 9/9, as well as the thumb-pressure opening 15 in the angled upper wall 14 can be seen.

In the preferred embodiment, as illustrated in FIGS. 1 and 2, the retaining device is constructed as a metal bracket 7 bent in a U-shape, which has a recess in each of the angled wall regions arranged in such a way that two opposing pairs of retaining fingers 8/8 and 9/9 are formed. When the bracket 7 is put on, the retaining fingers are engaged underneath the rim of the bottle and on the upper side of the stopper. At the same time, the recess on the upper side in the angled upper wall 14 forms a thumb-pressure opening 15 for the stopper part. This thumb-pressure opening 15 is important when putting on the bracket 7, as the stopper 1 can be pushed further into the bottle and is not pushed up, for example, by the pressure which has meanwhile increased slightly in the bottle. Thumb-pressure opening 15 is also extremely important when removing the bracket 7 and when reopening the bottle, since the stopper 1 would be catapulted out of the bottle due to the pressure injected at a higher level, if this pressure could not be retained with the thumb when removing bracket 7.

Figure 6:
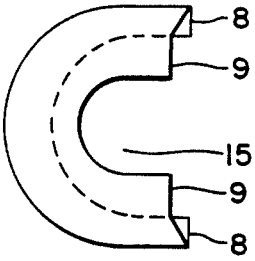
FIG. 6 shows the retaining device as a molded part with pairs of retaining fingers 8/8 and 9/9 which can be recognized accordingly, as well as the thumb-pressure opening 15.

As illustrated in FIG. 6, the retaining device may also be produced as a molded part, e.g. by plastic injection molding. However, it can also be constructed as a part made of wire bent in a particular configuration to retain the stopper, e.g. as a spring-lever retaining device.

The stopper 1, which is produced from rubber in the preferred embodiment, is constructed for easier insertion into the bottle by means of rubber ribs 2 formed around the circumference of the lower part of the stopper which flexibly bend and project 2.5 mm and are 1.3 mm thick in the preferred embodiment. The upper part of the rubber stopper is also constructed in a spherical manner 16, to enable the retaining device to be pushed over it more easily.

The particular advantage of stopper 1, which can be displaced axially in the bottle neck within the sealing seat, is the capability to compensate for possible differences in measurement of the bottle in the region from the lower edge of the rim of the bottle to the upper edge of the bottle opening for the retaining device. If this distance is shorter, then the stopper rises as a result of the internal pressure and ensures firm contact of the retaining device 7 underneath the rim 6 of the bottle.

Figure 3:
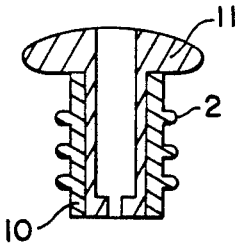
FIG. 3 shows a two-piece closure stopper which is produced from a hard core 11 with a soft sheathing 10.

According to FIG. 3, the stopper 1 may also be produced in two parts, consisting, for example, of a harder core part 11 and a softer sheathing 10 with ribs 2 projecting from the circumference of sheathing 10. The wire bracket of a spring-lever retaining device could also be mounted in the harder core part 11. Alternatively, the stopper 1 could be provided with 0-rings for sealing, instead of utilizing circumferential ribs.

Figure 4:
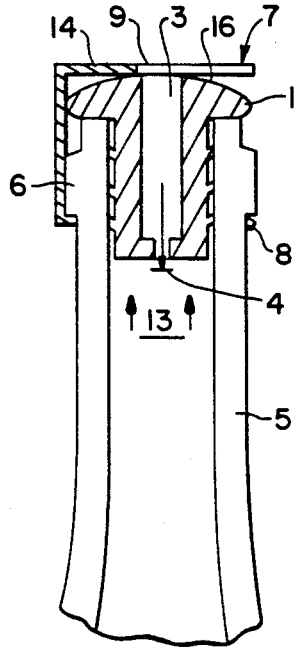
FIG. 4 shows the closure stopper 1 sitting in the bottle.
Figure 5:
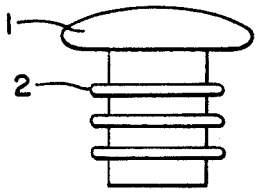
FIG. 5 shows the stopper 1 in its entirety with circumferential sealing ribs 2.

In order to close the opened bottle of sparkling wine, the stopper 1 is pushed easily into the bottle, because the circumferential rubber ribs 2, as shown in FIG. 4, bend over backwards in this process. To complete closing, the neck of the bottle is then grasped by the hand and the stopper 1 is pressed down with the thumb.

Next, the bracket 7 is pushed in arrow direction 12 on one side over the stopper 1, so that the retaining fingers 9/9 can slide in next to the thumb, which is pressing the stopper down.

In this process, the retaining fingers 8/8 are simultaneously pushed underneath the rim 6 of the bottle with the neck of the bottle being received in the recess or space formed between the fingers. The upper spherical shape 16 of the stopper 1 makes it easier to push the bracket over it.

Because of the thumb-pressure opening 15 in the angled upper wall 14 formed by the retaining fingers 9/9, it is possible to leave the thumb on the stopper until the bracket 7 is correctly attached.

The nipple of a pump or of a $CO_2$ pressure dispenser is now inserted into the injection bore 3. Compressed gas is then blown into the bottle via the non-return valve 4. The bottle can now be placed in a refrigerator for storage.

Figure 7:
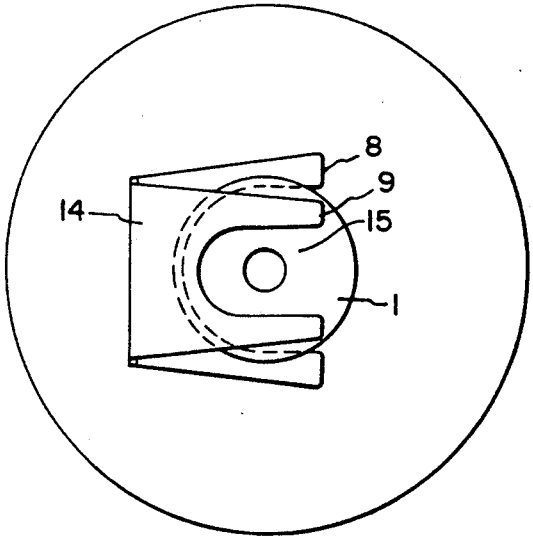
FIG. 7 shows the plan view of the fully closed bottle with inserted stopper 1 and the retaining device pushed over it, in the direction of arrow 12 of FIG. 1.

There is no risk of the bracket 7 falling off the bottle after closure, since the contact pressure between bracket 7 and stopper 1 prevents the bracket 7 from being able to slide down, because the stopper 1 sits in its sealing seat and is axially displaceable in the neck of the bottle. FIG. 7 illustrates a plan view of the closed bottle.

On re-opening the bottle, the identical process is followed. The hand is placed around the neck of the bottle, while the thumb, in turn, presses on the stopper 1 through the thumb-pressure opening 15 between the retaining fingers 9/9. With this motion, the bracket 7 can again be easily removed from the stopper 1 and the bottle.

The thumb-pressure opening above the rubber stopper is especially important for re-opening the bottle, which has been placed under pressure again for storage. The thumb pressure on the stopper 1 through the thumb-pressure opening 15, prevents the stopper 1 from being catapulted out as a result of the internal pressure after removal of the bracket 7.

Once the bracket 7 has been moved aside, the stopper 1 can be grasped with the free hand and slowly let out, and the sparkling fresh wine is then ready for pouring.

What is claimed is:

1. A closure device for keeping an opened bottle of sparkling wine fresh and providing for insertion of carbon dioxide, comprising:

a stopper having a head portion and an elongated shaft extending downwardly from said head portion which is insertable into a neck of said bottle, said stopper further having a gas passage bore defined along a vertical axis therein, and a non-return valve centrically disposed in said bore for feeding the carbon dioxide into the bottle;

a retaining device for retaining said stopper within said bottle neck, said retaining device comprising a generally U-shaped bracket having first and second angled walls;

at least two fork shaped lower fingers extending from said first angled wall and defining a first recess therein;

at least two fork shaped upper fingers extending from said second angled wall and defining a second recess in said second angled wall between said upper fingers, such that when said bracket is placed around said stopper to close the bottle, said lower fingers engage a rim of said bottle, and said upper fingers engage said head portion of the stopper, said second recess forming a thumb-pressure opening which enables said stopper to be pushed further into the bottle by placing a thumb within said thumb pressure opening, thereby allowing for easier insertion and removal of the stopper into the bottle neck and allowing for removal of said retaining device from said bottle neck while a thumb is inserted within said thumb pressure opening and pressed onto said stopper; and radially projecting ribs formed on said stopper shaft and extending in a circumferential direction to form sealing elements for sealing said stopper within said bottle.

2. A bottle closure device as claimed in claim 1, wherein said generally u-shaped bracket is metal which is stamped and bent to form said generally U-shape.

3. A bottle closure device as claimed in claim 1, wherein said retaining device is produced as a molded part.

4. A bottle closure device as claimed in claim 1, wherein said retaining device is produced as a part made of wire which is bent and is constructed as a spring-lever closure.

5. A bottle closure device as claimed in claim 1, wherein said head and shaft of said stopper are produced in one piece from rubber, and said stopper head is of spherical construction.

6. A bottle closure device as claimed in claim 1, wherein said stopper is produced in at least two parts, with said head portion and a core of said shaft being formed with a harder core part, and a rubber sleeve forms an exterior of said shaft and said circumferential ribs.

7. A bottle closure device as claimed in claim 1, wherein said radially projecting, circumferential ribs are constructed having a thickness of 1.3 mm and a projection length of 2.5 mm.

* * * * *